US012766656B2

(12) United States Patent
Shi et al.

(10) Patent No.: US 12,766,656 B2
(45) Date of Patent: Oct. 20, 2026

(54) PERMANENT MAGNET-ELECTROMAGNET HYBRID ARRAY TYPE MAGNETORHEOLOGICAL POLISHING DEVICE

(71) Applicant: NATIONAL UNIVERSITY OF DEFENSE TECHNOLOGY, Hunan (CN)

(72) Inventors: Feng Shi, Hunan (CN); Bo Wang, Hunan (CN); Guipeng Tie, Hunan (CN); Ci Song, Hunan (CN); Ye Tian, Hunan (CN); Shuo Qiao, Hunan (CN); Xing Peng, Hunan (CN)

(73) Assignee: NATIONAL UNIVERSITY OF DEFENSE TECHNOLOGY, Hunan (CN)

( * ) Notice: Subject to any disclaimer, the term of this patent is extended or adjusted under 35 U.S.C. 154(b) by 333 days.

(21) Appl. No.: 18/650,071

(22) Filed: Apr. 29, 2024

(65) Prior Publication Data

US 2024/0367278 A1 Nov. 7, 2024

(30) Foreign Application Priority Data

May 5, 2023 (CN) ..... 202310496599.1

(51) Int. Cl.
*B24B 1/00* (2006.01)
*B24B 41/00* (2006.01)

(52) U.S. Cl.
CPC ..... *B24B 1/005* (2013.01); *B24B 41/002* (2013.01)

(58) Field of Classification Search
CPC ..... B24B 1/005; B24B 1/002; B24B 7/00; B24B 27/00; B24B 37/00; B24B 37/042;
(Continued)

(56) References Cited

FOREIGN PATENT DOCUMENTS

CN 103465171 A * 12/2013
CN 106272086 A * 1/2017 ..... B24B 57/02
(Continued)

OTHER PUBLICATIONS

Translation of CN 109396969 A (Year: 2019).*
(Continued)

*Primary Examiner* — David S Posigian
*Assistant Examiner* — Steven Huang
(74) *Attorney, Agent, or Firm* — JCIPRNET

(57) ABSTRACT

The disclosure relates to a permanent magnet-electromagnet hybrid array type magnetorheological polishing device, comprising a polishing mechanism, a main excitation device arranged on the polishing mechanism, and auxiliary permanent magnet sets used for driving magnetorheological liquid to be recycled. The main excitation device is a permanent magnet-electromagnet hybrid array comprising main excitation permanent magnets and fine-adjustment electromagnetic excitation devices connected with the main excitation permanent magnets. Each fine-adjustment electromagnetic excitation device comprises a coil and a coil retaining pile. The main excitation device further comprises a permanent magnet-electromagnet device connecting plate made from a non-magnetically conductive material. The disclosure can improve magnetorheological polishing efficiency, reduce the size of the excitation device, and balance and control the thickness of a ribbon array, thus realizing high-accuracy and high-quality machining of the surfaces of elements and recycling of magnetorheological liquid.

7 Claims, 5 Drawing Sheets

(58) Field of Classification Search
CPC ... B24B 37/044; B24B 37/046; B24B 37/048; B24B 49/10; B24B 57/02; B24B 57/04
See application file for complete search history.

(56) References Cited

FOREIGN PATENT DOCUMENTS

| | | | | | |
|---|---|---|---|---|---|
| CN | 107825230 | A | * | 3/2018 | ..... B24B 41/04 |
| CN | 109396969 | A | * | 3/2019 | ..... B24B 13/00 |
| CN | 209110814 | U | * | 7/2019 | ..... B24B 37/27 |
| CN | 113510540 | A | * | 10/2021 | ..... B24B 1/005 |
| CN | 217668277 | U | * | 10/2022 | |

OTHER PUBLICATIONS

Translation of CN 107825230 A (Year: 2018).*
Translation of CN 113510540 A (Year: 2021).*
Translation of CN 217668277 U (Year: 2022).*
Translation of CN 209110814 U (Year: 2019).*
Translation of CN 106272086 A (Year: 2017).*
Translation of CN 103465171 A (Year: 2013).*

* cited by examiner

PERMANENT MAGNET-ELECTROMAGNET HYBRID ARRAY TYPE MAGNETORHEOLOGICAL POLISHING DEVICE

CROSS-REFERENCE TO RELATED APPLICATION

This application claims the priority benefit of China application serial no. 202310496599.1, filed on May 5, 2023. The entirety of the above-mentioned patent application is hereby incorporated by reference herein and made a part of this specification.

BACKGROUND OF THE DISCLOSURE

1. Technical Field

The disclosure relates to the technical field of mechanical and optical machining and theoretical simulation, in particular to a permanent magnet-electromagnet hybrid array type magnetorheological polishing device.

2. Description of Related Art

The rapid development of high-energy laser weapons, inertially confined fusion devices and other modern optical systems, leads to an increasingly greater demand for large-caliber intense light elements. However, existing manufacturing approaches have the problems of low manufacturing capacity, damage to elements and high damage increase rate. Existing magnetorheological polishing techniques for repairing and manufacturing large-caliber intense light elements in batches have low material removal efficiency and a long machining cycle. It is urgently needed to effectively improve the material removal efficiency of the magnetorheological polishing techniques under the precondition of guaranteeing high-accuracy and high-certainty removal.

Existing magnetorheological polishing devices typically include electromagnetic magnetorheological polishing devices and permanent-magnet magnetorheological polishing devices. The electromagnetic magnetorheological polishing devices indirectly change the magnetic field intensity indirectly by changing the magnitude of current and can give a response quickly, and the magnetic field disappears instantly when the current applied to the electromagnetic magnetorheological polishing devices is stopped. However, because the electromagnetic magnetorheological polishing devices generate the magnetic field by applying an intense current to multi-turn coils, a large quantity of heat will be produced and lead to rise of the temperature of magnetorheological fluid, thereby severely compromising the efficacy of the magnetorheological fluid and reducing the polishing quality. To solve this problem, a cooling water tank is often designed. However, the water tank and electromagnets will occupy a large space of the electromagnetic magnetorheological polishing device, the increase in size and weight will greatly reduce the dynamic characteristics of the electromagnetic magnetorheological polishing device, and it is difficult to expand magnetic poles to form multiple polishing ribbons, leading to a difficulty in improving polishing efficiency.

The permanent-magnet magnetorheological polishing devices generate a magnetic field by means of permanent magnets without producing heat, and even permanent magnets with a small size can generate a demanded magnetic field, so compared with the electromagnetic magnetorheological polishing devices, the space is greatly saved, and the weight is reduced. However, when magnetic poles of existing permanent-magnet magnetorheological polishing devices are expanded, two magnetic poles with opposite polarities are added in parallel, occupying more space. Moreover, once the permanent magnets are magnetized, the magnetic field intensity will not be changed, the magnetic field distribution will not be adjusted, and when the magnetic poles are expanded, magnetic field distributions on two sides are asymmetric due to the assembly, magnetization state, interaction of magnetic fields and other factors, leading to an inconsistency in thickness of generated polishing ribbons. During the machining process, when part of the polishing ribbons are used for polishing elements, the other part of polishing ribbons possibly fail to come into contact with the surfaces of the elements, thereby severely compromising material removal efficiency and surface accuracy control after machining. In addition, because the permanent-magnet magnetorheological polishing device generates a low magnetic field intensity in the circumferential direction of a polishing wheel, recycling of magnetorheological fluid is also an issue to be addressed.

BRIEF SUMMARY OF THE DISCLOSURE

In view of the abovementioned problems in the prior art, the disclosure provides a permanent magnet-electromagnet hybrid array type magnetorheological polishing device to improve magnetorheological polishing efficiency, reduce the size of excitation devices, and balance and control the thickness of a ribbon array to realize high-accuracy and high-quality machining of the surfaces of elements and recycle magnetorheological liquid.

To fulfill the above purpose, the embodiments of the invention adopt the following technical solution:

A permanent magnet-electromagnet hybrid array type magnetorheological polishing device, comprising: a polishing mechanism, a main excitation device arranged on the polishing mechanism, and auxiliary permanent magnet sets used for driving magnetorheological liquid to be recycled, wherein the main excitation device is a permanent magnet-electromagnet hybrid array comprising main excitation permanent magnets and fine-adjustment electromagnetic excitation devices connected with the main excitation permanent magnets.

In one embodiment of present disclosure, each said fine-adjustment electromagnetic excitation device comprises a coil and a coil retaining pile, and the coil is wound around the coil retaining pile.

In one embodiment of present disclosure, the permanent magnet-electromagnet hybrid array further comprises a permanent magnet-electromagnet device connecting plate made from a non-magnetically conductive material, and the main excitation permanent magnets and the fine-adjustment electromagnetic excitation devices are connected to the permanent magnet-electromagnet device connecting plate respectively; and the main excitation device comprises three said main excitation permanent magnets which are arranged in parallel, one end of each of the three main excitation permanent magnets is connected to the permanent magnet-electromagnet device connecting plate, and one fine-adjustment electromagnetic excitation device is arranged between two adjacent said main excitation permanent magnets.

In one embodiment of present disclosure, auxiliary permanent magnet set comprises two auxiliary permanent magnets and an auxiliary permanent magnet mounting plate made from a non-magnetically conductive material, and the two auxiliary permanent magnets are arc-shaped, mounted on the auxiliary permanent magnet mounting plate and respectively located on two sides of the main excitation device.

In one embodiment of present disclosure, the two auxiliary permanent magnets on the auxiliary permanent magnet set are arc-shaped and arranged eccentrically with respect to a center of the auxiliary permanent magnet mounting plate.

In one embodiment of present disclosure, the main excitation device is eccentrically arranged on a side of the permanent magnet-electromagnet hybrid array and located on a same side as the two eccentrically arranged auxiliary permanent magnets.

In one embodiment of present disclosure, the number of the auxiliary permanent magnet sets is two, and the two auxiliary permanent magnet sets are connected and fixed by means of an auxiliary magnetic pole connecting plate.

In one embodiment of present disclosure, notches are formed in the two auxiliary permanent magnet sets and a side of the auxiliary magnetic pole connecting plate, and the main excitation device is arranged in the notches.

In one embodiment of present disclosure, end covers are arranged on an outer side and an inner side of a part formed by the main excitation device, the auxiliary permanent magnet sets and the auxiliary magnetic pole connecting plate, grooves are formed in the end covers, and two ends of the main excitation device are inserted into the grooves in the end covers respectively.

In one embodiment of present disclosure, the polishing mechanism is a polishing wheel.

Compared with the prior art, the disclosure has the following advantages:

1. The permanent magnet-electromagnet hybrid array type magnetorheological polishing device provided by the disclosure comprises a permanent magnet-electromagnet hybrid array and a polishing mechanism connected with the permanent magnet-electromagnet hybrid array, the permanent magnet-electromagnet hybrid array comprises a main excitation device, and the main excitation device comprises main excitation permanent magnets and fine-adjustment electromagnetic excitation devices connected with the main excitation permanent magnets, such that the permanent magnet-electromagnet hybrid array type magnetorheological polishing device is simple in structure and easy to expand; and the main excitation permanent magnets and the two fine-adjustment electromagnetic excitation devices can be added as required to expand a polishing ribbon array.

2. The fine-adjustment electromagnetic excitation devices in the main excitation device of the permanent magnet-electromagnet hybrid array type magnetorheological polishing device provided by the disclosure are mainly used for finely adjusting the main magnetic field distribution formed below the two main excitation permanent magnets rather than generating magnetic fields, and only one main excitation permanent magnet and one fine-adjustment electromagnetic excitation device need to be added when one polishing ribbon is added, so compared with the original permanent magnet array type magnetic pole distribution requiring the addition of two parallel permanent magnets, the space occupied by the permanent magnet-electromagnet hybrid array type magnetorheological polishing device in the longitudinal direction is greatly reduced.

BRIEF DESCRIPTION OF THE SEVERAL VIEWS OF THE DRAWINGS

To more clearly explain the technical solutions of the embodiments of the disclosure or the prior art, drawings used for describing the embodiments of the disclosure or the prior art will be simply introduced below. Obviously, the following descriptions merely illustrate some embodiments of the disclosure, and those skilled in the art can obtain other drawings according to the structures shown by the following drawings without creative labor.

REFERENCE SIGNS

1, main excitation device; 11, main excitation permanent magnet; 12, fine-adjustment electromagnetic excitation device; 121, coil; 122, coil retaining pile; 13, permanent magnet-electromagnet device connecting plate; 2, auxiliary permanent magnet set; 21, auxiliary permanent magnet; 22, auxiliary permanent magnet mounting plate; 3, auxiliary magnetic pole connecting plate; 4, end cover; 41, groove; 5, polishing mechanism.

DETAILED DESCRIPTION OF THE DISCLOSURE

The technical solution of the disclosure is clearly and completely described below in conjunction with the accompanying drawings of the embodiments of the disclosure. Obviously, the embodiments in the following description are merely illustrative ones and are not all possible ones of the disclosure. All other embodiments obtained by those ordinarily skilled in the art according to the following ones without creative labor should also fall within the protection scope of the disclosure.

In the description of the disclosure, it should be noted that, terms such as "center", "upper", "lower", "horizontal", "inner", "outer", "top" and "bottom" are used to indicate directional or positional relations based on the accompanying drawings merely for the purpose of facilitating and simplifying the description of the disclosure, do not indicate or imply that devices or elements referred to must be in a specific direction or configured and operated in a specific direction, and thus should not be construed as limitations of the disclosure.

Figure 1:
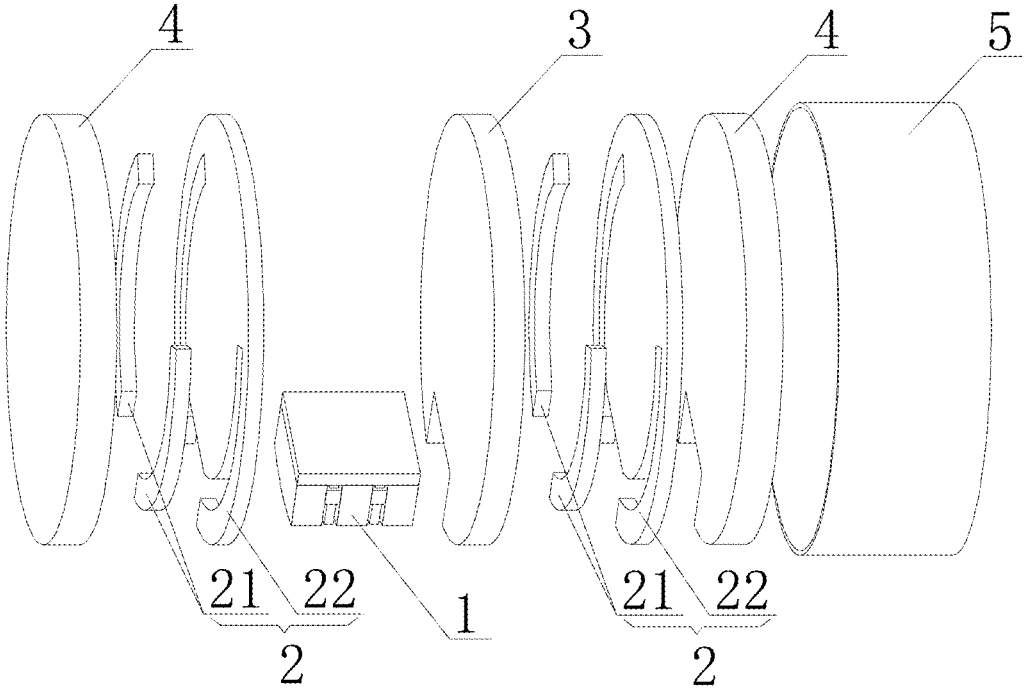
FIG. 1 is an exploded view of a polishing device according to one embodiment of the disclosure.
Figure 2:
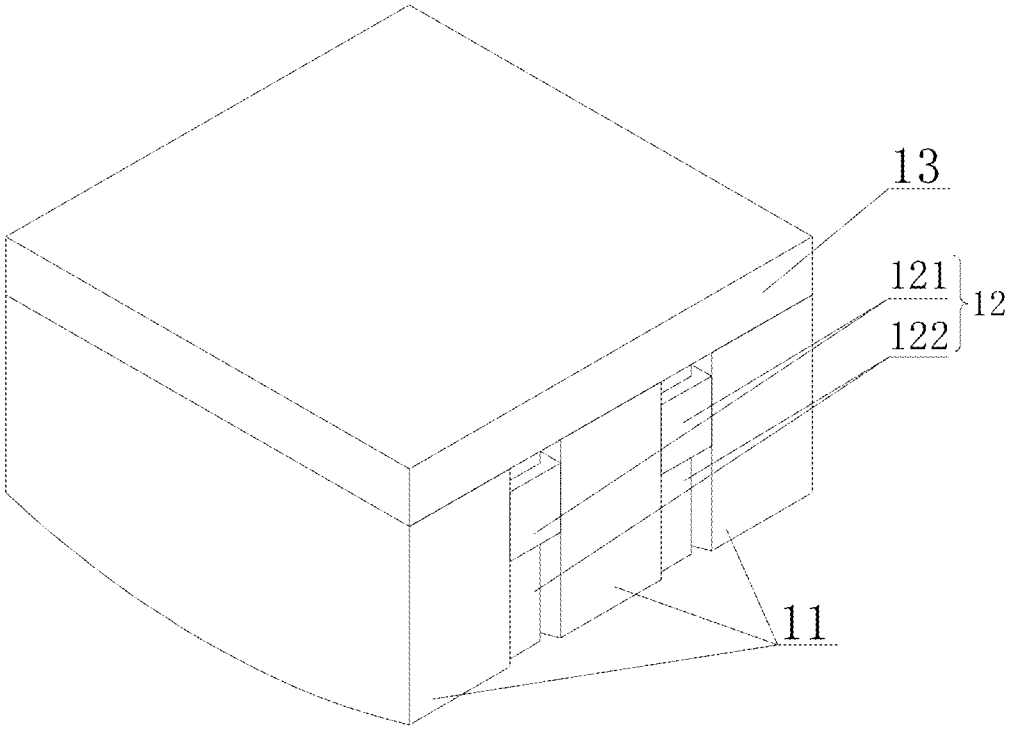
FIG. 2 is a perspective structural view of a main excitation device of the polishing device according to one embodiment of the disclosure.
Figure 3:
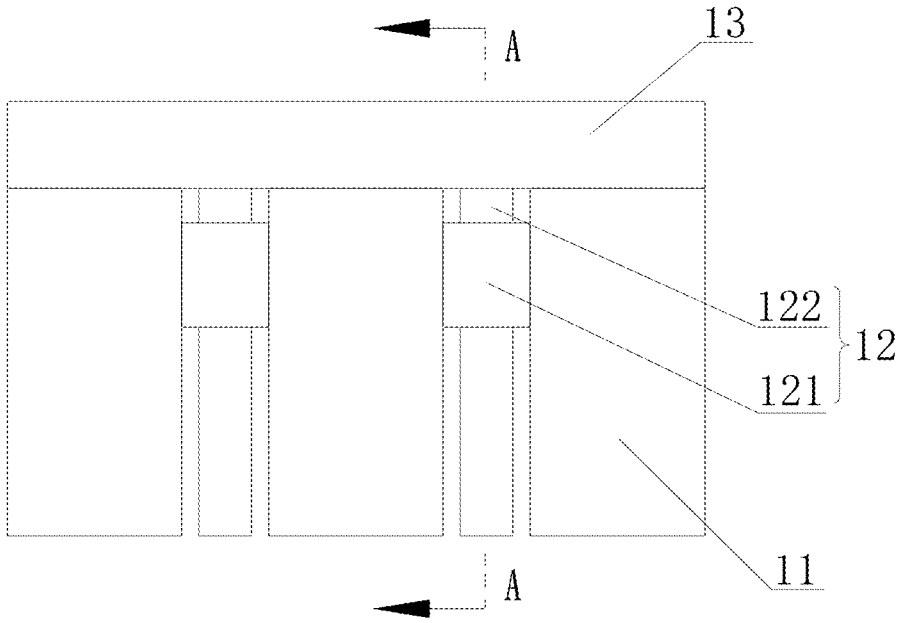
FIG. 3 is a front view of the main excitation device of the polishing device according to one embodiment.

Referring to FIG. 1, FIG. 2 and FIG. 3, one embodiment of the disclosure provides a permanent magnet-electromagnet hybrid array type magnetorheological polishing device, comprising a polishing mechanism 5, a main excitation device 1 arranged on the polishing mechanism 5, and auxiliary permanent magnet sets 2 used for driving magnetorheological liquid to be recycled, wherein the main excitation device 1 is a permanent magnet-electromagnet hybrid array comprising main excitation permanent magnets 11 and fine-adjustment electromagnetic excitation devices 12 connected with the main excitation permanent magnets 11.

Figure 4:
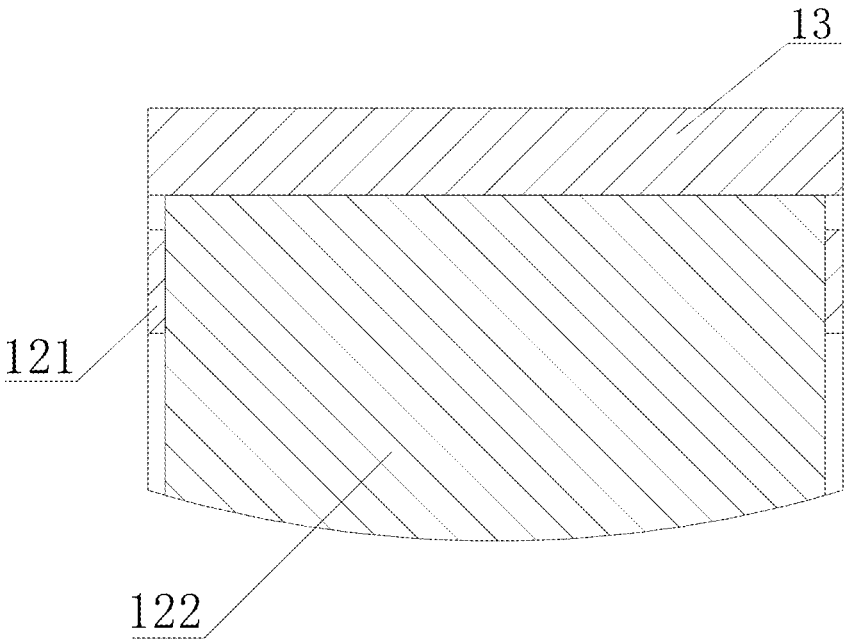
FIG. 4 is a sectional view of the main excitation device of the polishing device along A-A according to one embodiment of the disclosure.

Referring to FIG. 4, the fine-adjustment electromagnetic excitation device 12 comprises a coil 121 and a coil retaining pile 122, wherein the coil 121 is wound around the coil retaining pile 122. The number of turns of the coil 121 can be determined as required. For example, in this embodiment, the number of turns of the coil 121 is 100. The height of the coil retaining pile 122 can be designed as actually needed. For example, in this embodiment, the height of the coil retaining pile 122 is 20 mm. A lower portion of the coil retaining pile 122 is arc-shaped to form a side face of the permanent magnet-electromagnet hybrid array, and the radius of the arc-shaped lower portion of the coil retaining pile 122 is 74 mm. In this embodiment, the coil 121 is made from copper, and the coil retaining pile 122 is made from electrotechnical pure iron. When a current is applied to the coil 121, a magnetic field is guided along the coil retaining pile 122 into a main magnetic field area below the corresponding main excitation permanent magnet 11 to provide a fine-adjustment magnetic field for the device.

It can be understood that, when a small current is applied to the coils 121, a vertically downward magnetic field will be generated to finely adjust the main magnetic field distribution formed below the two main excitation permanent magnets 11, such that magnetorheological polishing ribbons distributed in an array are located in approximately the same magnetic field environment during machining, and the polishing ribbons are basically identical in thickness, thus multiplying magnetorheological polishing efficiency and guaranteeing high-accuracy and high-certainty removal. Moreover, because the fine-adjustment electromagnetic excitation devices 12 are not mainly used for generating magnetic fields, the coils 121 produce little heat, and a water cooling device is not needed. In addition, only one main excitation permanent magnet 11 and one fine-adjustment electromagnetic excitation device 12 need to be added when one polishing ribbon is added, so compared with the original permanent magnet array type magnetic pole distribution requiring the addition of two parallel permanent magnets, the space occupied by the permanent magnet-electromagnet hybrid array type magnetorheological polishing device in the longitudinal direction is greatly reduced.

A lower end of the main excitation permanent magnet 11 is arc-shaped to form a side face of the permanent magnet-electromagnet hybrid array, an upper end of the main excitation permanent magnet 11 is rectangular and fixedly connected to a permanent magnet-electromagnet device connecting plate 13. The main excitation permanent magnet 11 is made from rubidium-ferrum-boron N-52 and has an extremely high magnetic field intensity after being magnetized. The thickness of the main excitation permanent magnet 11 is 10 mm, the distance between two main excitation permanent magnets 11 is 5 mm, a protrusive high-intensity gradient magnetic field is formed in a gap between the lower ends of the two main excitation permanent magnets 11, and polishing ribbons used for polishing are formed by magnetorheological fluid under the action of the gradient magnetic field.

Referring to FIG. 1-FIG. 4, the main excitation device 1 (the permanent magnet-electromagnet hybrid array) further comprises the permanent magnet-electromagnet device connecting plate 13, and the coil retaining piles 122 are fixedly connected to the permanent magnet-electromagnet device connecting plate 13. The main excitation device 1 comprises three main excitation permanent magnets 11 which are arranged in parallel, one end of each of the three main excitation permanent magnets 11 is fixedly connected to the permanent magnet-electromagnet device connecting plate 13, and one fine-adjustment electromagnetic excitation device 12 is arranged between every two adjacent main excitation permanent magnets 11.

Figure 5:
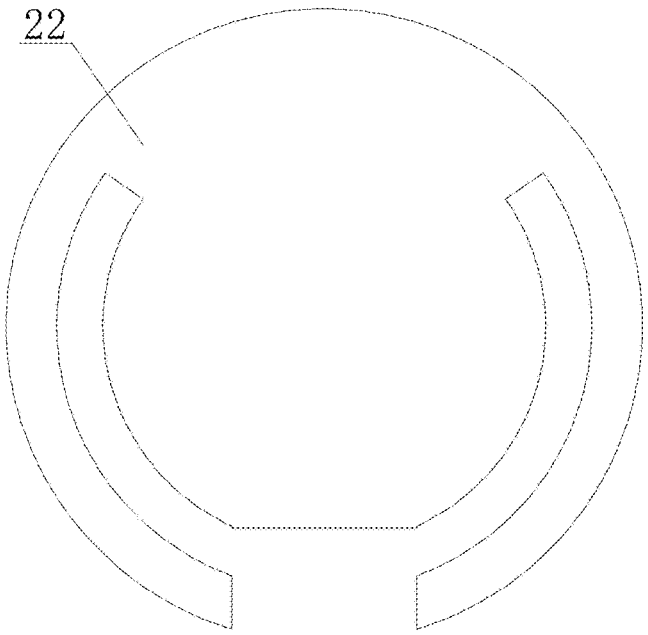
FIG. 5 is a top view of an auxiliary permanent magnet mounting plate of the polishing device according to one embodiment of the disclosure.

The auxiliary permanent magnet sets 2 are used for generating a weak magnetic field on the surface of the polishing mechanism 5 to allow the magnetorheological fluid to be recycled by a recycling device. Referring to FIG. 1 and FIG. 5, in this embodiment, the permanent magnet-electromagnet hybrid array type magnetorheological polishing device further comprises two auxiliary permanent magnet sets 2. The auxiliary permanent magnet set 2 comprises two auxiliary permanent magnets 21 and an auxiliary permanent magnet mounting plate 22, wherein the two auxiliary permanent magnets 21 are arc-shaped, mounted on the auxiliary permanent magnet mounting plate 22 and respectively located on two sides of the main excitation device 1. The two auxiliary permanent magnets 21 on the auxiliary permanent magnet set 2 are arc-shaped and arranged eccentrically with respect to the center of the auxiliary permanent magnet mounting plate 22. The distance between excircle surfaces of the auxiliary permanent magnets 21 and an excircle surface of the auxiliary permanent magnet mounting plate 22 is 3 mm. The main excitation device 1 is eccentrically arranged on one side of the permanent magnet-electromagnet hybrid array and located on a same side as the two eccentrically arranged auxiliary permanent magnets 21, such that a polishing area is formed in one side, where the main excitation device 1 and the auxiliary permanent magnets 21 are eccentrically arranged, of the polishing mechanism 5, and a non-polishing area is formed in the other side of the polishing mechanism 5. The auxiliary permanent magnets 21 are mounted on the auxiliary permanent magnet mounting plate 22 and respectively located on two sides of the main excitation device 1, such that a weak magnetic field area (marked as b in FIG. 8) is formed on the side, where the main excitation device 1 is located, of the polishing mechanism 5, and a non-magnetic field area is formed on the side, without the main excitation device 1 and the auxiliary permanent magnets 21, of the polishing mechanism 5, and the weak magnetic field area and the non-magnetic field area form the non-polishing area. Because the magnetorheological fluid will turn to a semi-solid state in the presence of a magnetic field and turn to a liquid state in the absence of a magnetic field, the magnetorheological fluid in the liquid state can be recycled easily by the recycling device in the weak magnetic field area.

It can be understood that the direction of magnetization of the auxiliary permanent magnets 21 is parallel to the axial direction of the polishing mechanism 5, and a protrusive magnetic field with a maximum magnetic field intensity of 18 mT is formed in the non-polishing area of the polishing mechanism 5 to satisfy the requirement for recycling the magnetorheological fluid, such that the magnetorheological fluid can be smoothly carried into the polishing area and can be smoothly recycled.

Mounting grooves for mounting the auxiliary permanent magnets 21 on the auxiliary permanent magnet mounting plate 22 are formed from a left or right 30° direction of a disk's axis of symmetry, and the specific positions of the mounting grooves are designed according to the size and position of the magnetorheological fluid recycling device.

In this embodiment, the permanent magnet-electromagnet hybrid array further comprises an auxiliary magnetic pole connecting plate 3, and the two auxiliary permanent magnet sets 2 are connected by means of the auxiliary magnetic pole connecting plate 3. Notches are formed in one side of the two auxiliary permanent magnet sets 2 and one side of the auxiliary magnetic pole connecting plate 3, and the main excitation device 1 is arranged in the notches.

Figure 6:
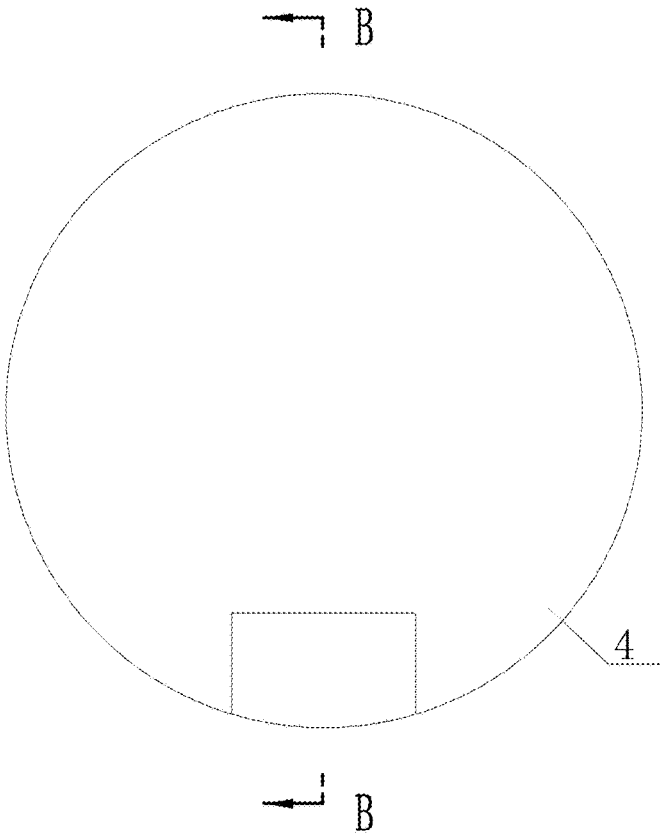
FIG. 6 is a top view of an inner end cover of the polishing device according to one embodiment of the disclosure.
Figure 7:
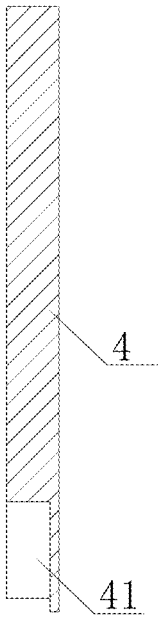
FIG. 7 is a sectional view of the inner end cover of the polishing device along B-B according to one embodiment of the disclosure.

Referring to FIG. 1, FIG. 6 and FIG. 7, end covers 4 are arranged on an outer side and an inner side of a part formed by the main excitation device 1, two auxiliary permanent magnet sets 2 and the auxiliary magnetic pole connecting plate 3, grooves 41 are formed in the end covers 4, and two ends of the main excitation device 1 are inserted into the grooves 41 in the end covers 4 respectively, such that the main excitation device 1 is fixed firmly. In addition, outer sides of the two auxiliary permanent magnet sets 2 are fixedly connected to inner walls of the end covers 4 respectively.

In one embodiment of the disclosure, the permanent magnet-electromagnet device connecting plate 13, the auxiliary permanent magnet mounting plate 22, the auxiliary magnetic pole connecting plate 3, the outer end cover 4 and the inner end cover 4 are all made from non-magnetically conductive materials such as stainless steel and aluminum alloy to avoid a change of the existing magnetic field distribution, such that the performance of the whole permanent magnet-electromagnet hybrid array type magnetorheological polishing device is stable.

In this embodiment, the polishing mechanism 5 is a polishing wheel and has an outer diameter of 153 mm and an inner diameter of 150 mm. The arc-shaped lower end of the main excitation device 1 has a curvature radius of 74 mm and is concentric with the polishing wheel, and the distance from the main excitation device 1 to an inner wall of the polishing wheel is 1 mm.

Figure 8:
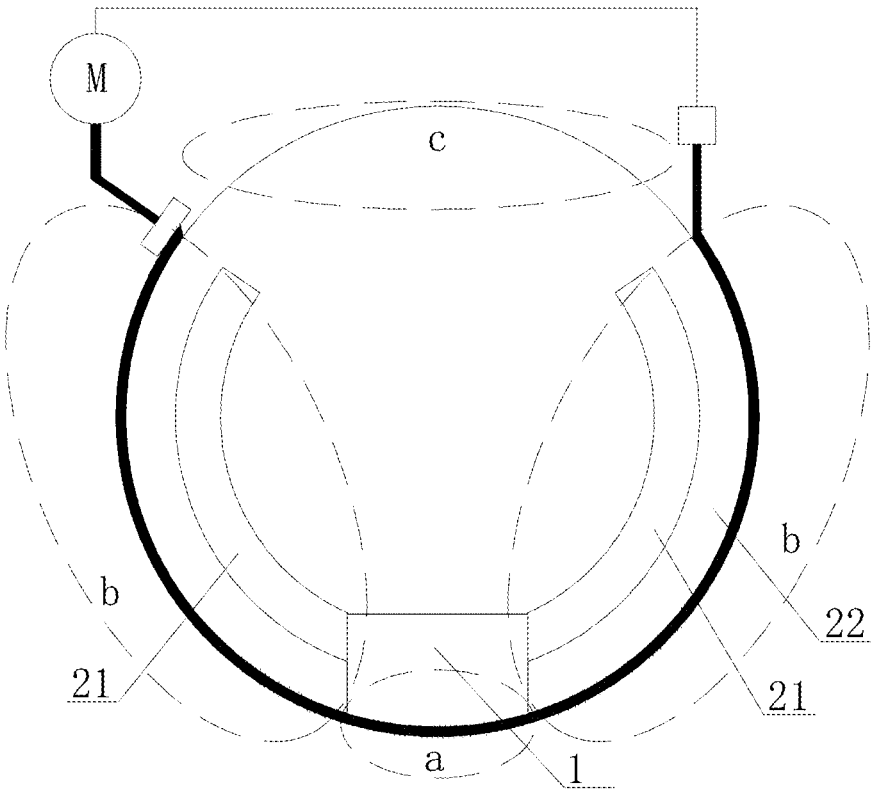
FIG. 8 is a schematic diagram of the operating principle of the polishing device according to one embodiment of the disclosure.

As shown in FIG. 8, the operating principle of the permanent magnet-electromagnet hybrid array type magnetorheological polishing device in this embodiment is as follows: in the circumferential direction, the polishing mechanism 5 is divided into a strong magnetic field area (marked as a in FIG. 8) corresponding to the main excitation device 1, weak magnetic field areas (marked as b in FIG. 8) corresponding to the two auxiliary permanent magnets 21 of the auxiliary permanent magnet sets 2, and a non-magnetic field area (marked as c in FIG. 8) on the other side, magnetorheological fluid is driven by a magnetorheological fluid circulation system to be delivered to the weak magnetic field area b on one side by a spray pipe, then enters the strong magnetic field area a to turn to a solid state to polish workpieces, and finally passes through the weak magnetic field area b on the other side to be recycled by a recycling mechanism of the magnetorheological fluid circulation system.

Figure 9:
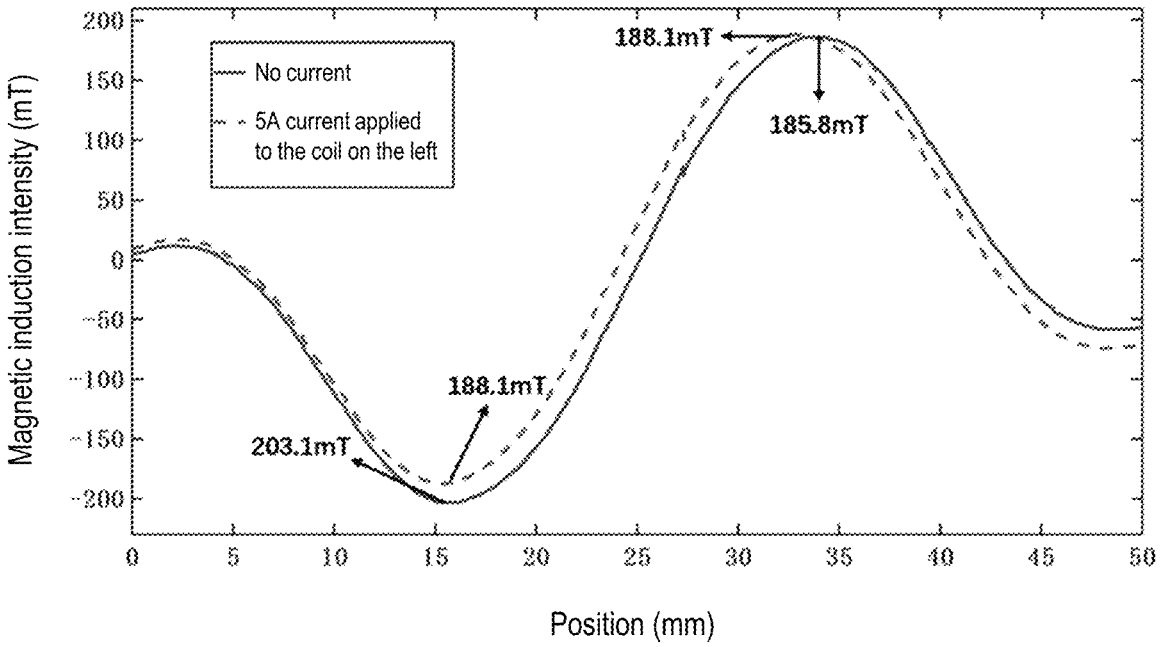
FIG. 9 illustrates a magnetic field intensity simulation result of the polishing device according to one embodiment of the disclosure.

Referring to FIG. 9, the feasibility of the permanent magnet-electromagnet hybrid array type magnetorheological polishing device is analyzed by magnetic field simulation, which uses Solidworks as three-dimensional model construction software and uses Comsol as permanent magnet-electromagnet coupled field analysis software, and the main magnetic field intensity distribution on the surface of the polishing mechanism 5 at the lower end of the main excitation device 1 is obtained by simulation. During simulation, the magnetic field intensity distribution in a case where no current is applied to the two coils 121 and the magnetic field intensity distribution in a case where a 5A current is applied to the coil 121 on the left and no current is applied to the other coil 121 are simulated. In the case where no current is applied to the coils 121, the magnetic field intensities of two polishing areas on the surface of the polishing wheel are different due to the interaction of magnetic fields, wherein the magnetic field intensity of the polishing area on the left is 203.1 mT, the magnetic field intensity of the polishing area on the right is 185.8 mT, and two polishing ribbons with different thicknesses are formed on the two areas. In the case where a 5A current is applied to the coil 121 on the left, the magnetic field intensities of the left and right polishing areas of the polishing wheel are both 181.1 mT, and two polishing ribbons with the same thickness are formed in the two areas.

When entering the area, under the action of the magnetic field of the auxiliary permanent magnet sets 2, on the surface of the polishing wheel, the magnetorheological fluid is adhered to the surface of the polishing mechanism 5 under the action of an auxiliary magnetic field to be carried into the polishing area; and in the polishing area, the main excitation device 1 generates a high-intensity gradient magnetic field, the magnetorheological fluid turns into a polishing ribbon in a Bingham state under the action of the gradient magnetic field, and the main excitation permanent magnets 11 provide a main magnetic field for the device. Because the magnetic field distribution in the polishing area may be asymmetric due to the interaction of most strong magnetic field areas and assembly errors of the main excitation permanent magnets 11, a current is applied to the coils 121 to guide the magnetic field into the area of the main magnetic field below the main excitation permanent magnets 11 along the coil retaining piles 122 to realize fine adjustment of the magnetic field of the device, thus balancing the magnetic field distribution in the polishing area. In addition, the magnetic field intensity in the polishing device of the device can be changed within a certain range by applying different currents to the coils. Only one main excitation permanent magnet 11 and one fine-adjustment electromagnetic excitation device 12 need to be added when one polishing ribbon is added, such that multiple polishing ribbons can be formed by connection and expansion to improve polishing efficiency. After polishing, the magnetorheological fluid will be adhered to the polishing mechanism 2 to be carried into the auxiliary magnetic field area generated by the auxiliary permanent magnet sets 2 to return to the recycling device to be recycled, thus effectively improving the material removal efficiency of the magnetorheological polishing technique under the precondition of guaranteeing high-accuracy and high-certainty removal.

The above embodiments are merely preferred ones of the disclosure and are not intended to limit the disclosure. Any skilled in the art can make some possible transformations and embellishments to the technical solution of the disclosure or modify the above embodiments into equivalent embodiments based on the technical contents disclosed above without departing from the scope of the technical solution of the disclosure. Therefore, any simple modifications, equivalent transformations and embellishments made to the above embodiments according to the technical essence of the disclosure without departing from the technical solution of the disclosure should also fall within the protection scope of the technical solution of the disclosure.

What is claimed is:

1. A permanent magnet-electromagnet hybrid array type magnetorheological polishing device, comprising: a polishing mechanism, a main excitation device arranged on the polishing mechanism, and auxiliary permanent magnet sets configured to drive magnetorheological liquid to be recycled, wherein the main excitation device is a permanent magnet-electromagnet hybrid array comprising main excitation permanent magnets and fine-adjustment electromagnetic excitation devices connected with the main excitation permanent magnets, wherein the polishing mechanism is a polishing wheel, wherein each fine-adjustment electromagnetic excitation device comprises a coil and a coil retaining pile, and the coil is wound around the coil retaining pile, wherein the permanent magnet-electromagnet hybrid array further comprises a permanent magnet-electromagnet device connecting plate made from a non-magnetically conductive material, and the main excitation permanent magnets and the fine-adjustment electromagnetic excitation devices are connected to the permanent magnet-electromagnet device connecting plate respectively; and the main excitation device comprises three main excitation permanent magnets which are arranged in parallel, one end of each of the three main excitation permanent magnets is connected to the permanent magnet-electromagnet device connecting plate, and the each fine-adjustment electromagnetic excitation device is arranged between two adjacent main excitation permanent magnets.

2. A permanent magnet-electromagnet hybrid array type magnetorheological polishing device, comprising: a polishing mechanism, a main excitation device arranged on the polishing mechanism, and auxiliary permanent magnet sets configured to drive magnetorheological liquid to be recycled, wherein the main excitation device is a permanent magnet-electromagnet hybrid array comprising main excitation permanent magnets and fine-adjustment electromagnetic excitation devices connected with the main excitation permanent magnets, wherein the polishing mechanism is a polishing wheel, wherein each fine-adjustment electromagnetic excitation device comprises a coil and a coil retaining pile, and the coil is wound around the coil retaining pile, wherein each auxiliary permanent magnet set comprises two auxiliary permanent magnets and an auxiliary permanent magnet mounting plate made from a non-magnetically conductive material, and the two auxiliary permanent magnets are arc-shaped, mounted on the auxiliary permanent magnet mounting plate and respectively located on two sides of the main excitation device.

3. The permanent magnet-electromagnet hybrid array type magnetorheological polishing device according to claim 2, wherein the two auxiliary permanent magnets of at least one auxiliary permanent magnet set of the auxiliary permanent magnet sets are arranged eccentrically with respect to a center of the auxiliary permanent magnet mounting plate.

4. The permanent magnet-electromagnet hybrid array type magnetorheological polishing device according to claim 3, wherein the main excitation device is eccentrically arranged on a side of the polishing mechanism and located on a same side as the two eccentrically arranged auxiliary permanent magnets.

5. The permanent magnet-electromagnet hybrid array type magnetorheological polishing device according to claim 2, wherein the number of the auxiliary permanent magnet sets is two, and the two auxiliary permanent magnet sets are connected and fixed by means of an auxiliary magnetic pole connecting plate.

6. The permanent magnet-electromagnet hybrid array type magnetorheological polishing device according to claim 5, wherein notches are formed in the two auxiliary permanent magnet sets and a side of the auxiliary magnetic pole connecting plate, and the main excitation device is arranged in the notches.

7. The permanent magnet-electromagnet hybrid array type magnetorheological polishing device according to claim 5, wherein end covers are arranged on an outer side and an inner side of a part formed by the main excitation device, the auxiliary permanent magnet sets and the auxiliary magnetic pole connecting plate, grooves are formed in the end covers, and two ends of the main excitation device are inserted into the grooves in the end covers respectively.

* * * * *